US005276940A

United States Patent [19]

Renaudin

[11] Patent Number: 5,276,940

[45] Date of Patent: Jan. 11, 1994

[54] VACUUM CLEANER TRAIN FOR CLEANING TRACKS, PARTICULARLY FOR UNDERGROUND RAILWAY NETWORKS

[75] Inventor: Yves Renaudin, La Madeleine, France

[73] Assignee: Neu Process International S.A., France

[21] Appl. No.: 904,605

[22] Filed: Jun. 26, 1992

[30] Foreign Application Priority Data

Dec. 13, 1991 [FR] France ..... 91 16067

[51] Int. Cl.[5] ..... A47L 5/14

[52] U.S. Cl. ..... 15/345; 15/354

[58] Field of Search ..... 15/312.1, 345, 346, 15/354

[56] References Cited

U.S. PATENT DOCUMENTS

| | | | |
|---|---|---|---|
| 705,585 | 7/1902 | Hope | 15/354 X |
| 750,852 | 2/1904 | Hart | 15/354 |
| 936,256 | 10/1909 | Quertier | 15/345 |
| 1,187,209 | 6/1916 | Warner | 15/346 |
| 1,211,902 | 1/1917 | Warner | 15/346 |
| 1,483,674 | 2/1924 | Owen | 15/312.1 X |
| 3,163,879 | 1/1965 | Lamb | 15/312.1 |
| 3,936,905 | 2/1976 | Stewart et al. | 15/354 X |
| 4,457,043 | 7/1984 | Oeberg et al. | 15/346 |
| 4,570,287 | 2/1986 | Kerschner et al. | 15/346 |
| 4,938,239 | 7/1990 | Theurer et al. | 15/346 X |

FOREIGN PATENT DOCUMENTS 2074564 10/1971 France .

*Primary Examiner*—Stephen F. Gerrity
*Attorney, Agent, or Firm*—Ladas & Parry

[57] ABSTRACT

A vacuum cleaner train comprises a blowing device mounted transversely and two suction devices disposed downstream and upstream of the blowing device with respect to the direction of the train. It is provided with deflectors for transversely deviating the blowing and suction flows to effect to a non-homogeneous distribution of said flows. The blowing and suction devices comprise nozzles equipped with obturation systems and apparatus for controlling the obturation system in synchronization. Moreover, the end piece of the nozzles may be orientable laterally for cleaning overhanging platforms.

5 Claims, 3 Drawing Sheets

VACUUM CLEANER TRAIN FOR CLEANING TRACKS, PARTICULARLY FOR UNDERGROUND RAILWAY NETWORKS

FIELD OF THE INVENTION

The present invention relates to a vacuum cleaner train for cleaning tracks, particularly of underground railway networks. It relates more particularly to a vacuum cleaner train comprising a suction and blowing hood covering the cleaning zone, and equipped, on the one hand, with a high speed air blowing device intended to detach the dust and debris from the surface to be cleaned and disposed transversely with respect to the direction of displacement of the train, and, on the other hand, with two suction devices disposed respectively, one, upstream and the other, downstream of the blowing device and intended to pick up the dust and debris lifted by the blowing device.

BACKGROUND OF THE INVENTION

A vacuum cleaner train of this type is known, particularly by document FR A 2 074 564. According to the teaching of this document, the suction devices are equipped with supple deflectors, sectioned in the form of a convergent-divergent duct; this particular embodiment aims at improving the pick-up of the dust and debris by the suction devices, avoiding a sudden dispersion of this dust and debris under the action of the blowing pipe, out of the zone of suction and blowing action.

However, the improvement contributed in this document FR A 2 074 564 does not totally optimalize the cleaning of the tracks, in particular when there are pits located longitudinally between the rails, when there are projecting platforms, i.e. when the end of the platform is an extension in overhang arriving near the track, and, finally, when the vacuum cleaner train is intended to clean small and medium networks and is therefore a train of reduced dimensions.

It is an object of the present invention to propose an improved vacuum cleaner train which overcomes the drawbacks set forth hereinabove in that it allows an optimal cleaning of all the configurations of the tracks and it may suit small and medium networks.

SUMMARY OF THE INVENTION

This object is perfectly attained by the vacuum cleaner train of the invention, with blowing and suction hood which, in known manner, comprises a blowing device mounted transversely and two suction devices disposed, one, downstream and, the other, upstream of the blowing device, said vacuum cleaner train being characterized in that it comprises means for transversely adapting the blowing and suction flows, adapted to effect a non-homogeneous distribution of said flows transversely with respect to the direction of the train.

Thus, thanks to the transverse adaptation means, it is possible to concentrate the blowing and suction flows on a particular zone of the track and consequently obtain a perfect cleaning of this particular zone.

According to a first version, intended for small and medium networks, the blowing and suction hood comprising a blowing pipe connected to a draft fan and two suction pipes disposed respectively downstream and upstream of the blowing pipe, and each connected to a suction fan, said pipes are partitioned into three independent compartments, transversely defining three work zones; moreover, the hood comprises three supple conduits for connection to the three draft and suction fans and it also comprises means for positioning said conduits, adapted to place the three conduits in position of connection with a given compartment.

In this first version, the means for transversely adapting the blowing and suction flows consist in the positioning means adapted to effect the displacement and connection in synchronization of the three conduits for connection with one of the compartments of the blowing and suction pipes.

When a vacuum cleaner train of this type is intended for cleaning small and medium networks, complete cleaning of the track is effected in three passages, each employing the three compartments respectively. As the zone to be cleaned is of smaller dimensions, the suction and blowing powers will be less great and consequently the fans of likewise smaller dimensions.

This first version of the vacuum cleaner train may also be suitable for cleaning tracks which comprise a central pit, located between the rails, in particular the anti-suicide pits located in the stations. In that case, the three connection conduits are positioned on the central compartment of the blowing and suction pipes.

According to a second version, the blowing and suction hood comprises a set of transversely juxtaposed blowing nozzles and two sets of suction nozzles disposed upstream and downstream of the blowing nozzles, and each nozzle is equipped with obturation means; moreover, the vacuum cleaner train comprises control means adapted to control in synchronization the obturation means of certain blowing and suction nozzles so as to channel the blowing and suction flows towards a given zone.

In this second version, the transverse adaptation of the blowing and suction flows consists in the means for obturating the blowing and suction nozzles as well as in the means for controlling these obturation means.

It will be understood that, with respect to the first version described above, it is possible to work in much more supple manner on a precise work zone. To that end, it suffices to choose the blowing and suction nozzles corresponding to this precise zone. It goes without saying that, when one speaks of synchronization, it is necessarily question of employing a blowing nozzle and two suction nozzles disposed longitudinally with respect to the blowing nozzle upstream and downstream thereof.

The vacuum cleaner train of the invention preferably comprises means for transversely deviating the blowing and suction flows.

The purpose of these transverse deviation means is to direct the blowing and suction flows outside the zone covered by the hood and to allow a good cleaning of the track beyond the rails. In particular, when it is question of a track having a platform in overhang thereover, the transverse deviation of the blowing flow creates an eddying movement of the air in the cavity located beneath the projecting platform. This eddying movement makes it possible to lift the dust and debris located in this cavity which is normally inaccessible to the vacuum cleaner train. The deviation of the suction flows makes it possible to collect the dust and debris taken along in this eddying movement.

The means for transversely deviating the flows may consist of deflectors, mounted at the end of the lateral blowing and suction nozzles and directed obliquely towards the outside of the hood.

It may be question of deflectors which are fixedly mounted on the sides of the hood.

However, the corresponding nozzle preferably comprising a supple conduit, the deflector is orientable by rotation about a horizontal and longitudinal axis, and the vacuum cleaner train comprises means for controlling rotation of the deflectors.

In this latter case, the driver of the vacuum cleaner train may control, without stopping said train, the transverse deviation of the blowing and suction flows when he enters a station which comprises overhanging platforms.

According to a preferred version, the vacuum cleaner train of the invention comprises a set of four blowing nozzles disposed transversely, two central nozzles and two lateral nozzles surrounding the two central nozzles, as well as two sets of six suction nozzles, one set being located upstream and the other downstream of the set of blowing nozzles; moreover, in each set of suction nozzles, four are exactly opposite the four blowing nozzles and two are beyond these four first ones disposed opposite the lateral nozzles; the end lateral suction nozzles are provided with deflectors mobile in rotation, whilst the two intermediate lateral suction nozzles are provided with fixed deflectors.

Thanks to the presence of the four lateral suction nozzles, surrounding the lateral blowing nozzle, and the possibility of adjusting the deviation of the two end lateral suction nozzles, it is possible to obtain a highly efficient cleaning for all overhanging platforms whatever their dimensions.

The vacuum cleaner train preferably also comprises sealing strips, laterally extending the blowing and suction hood and disposed so as to form with the edge of the platform a caisson, disposed on the side of the train and substantially tight.

The sealing strips consist for example of a horizontal strip extending over the whole length of the hood, terminated at its ends by two vertical strips, said strips being fixed in overhang on the frame of the hood.

The presence of these sealing strips makes it possible to maintain the air moving the dust and debris in a well determined zone, avoiding any excessive loss, which tends, on the one hand, to increase efficiency of cleaning and, on the other hand, to reduce the consumption of blown and sucked air.

BRIEF DESCRIPTION OF THE DRAWINGS

The invention will be more readily understood on reading the following description with reference to the accompanying drawings, in which.

DETAILED DESCRIPTION OF THE DRAWINGS

A vacuum cleaner train is a train on which is mounted all the equipment necessary for cleaning the track by suction. A vacuum cleaner train conventionally comprises a blowing installation, a suction installation and an installation for filtering and collecting residual dust and debris.

Figure 5:
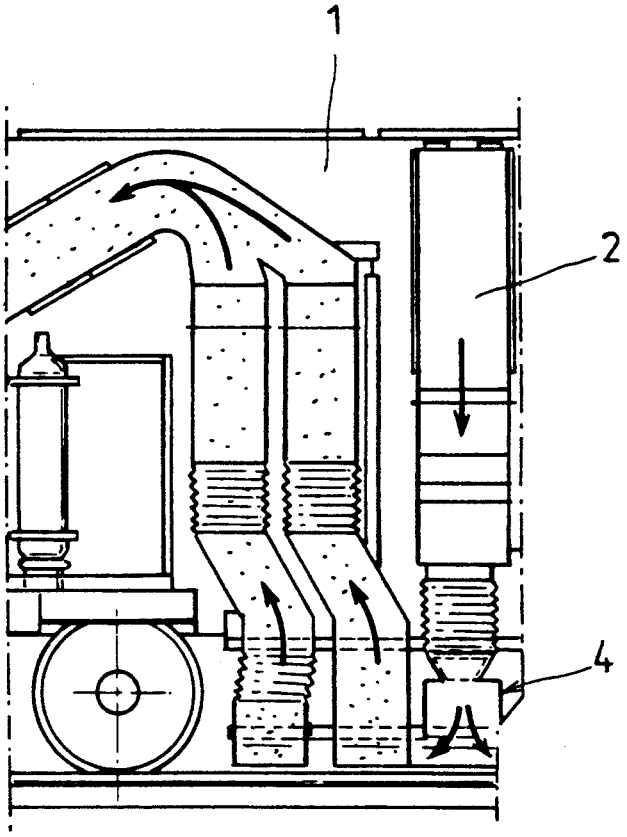
FIG. 5 is a partial view in longitudinal section along axis BB of FIG. 2 of a vacuum cleaner train with four lateral suction nozzles.

FIG. 5 shows a partial view of the blowing and suction installations which are mounted on the frame 1 of the train. The blowing installation comprises a fan (not shown in FIG. 5) which propels the air at high speed in a collector 2, giving either into a blowing pipe disposed transversely with respect to the direction of displacement of the train, or into different blowing nozzles 4 juxtaposed with respect to one another along a transverse axis with respect to the displacement of the train.

As far as the suction installation is concerned, it comprises fans, preferably two fans, each being connected either to a suction pipe disposed upstream or downstream of the blowing pipe, or to suction nozzles juxtaposed transversely with respect to one another opposite the blowing nozzles.

The high speed air jet blown by the blowing pipe or blowing nozzles serves to detach the debris and dust on the ballast to allow suction thereof by the suction pipe or nozzles disposed in the immediate proximity of the blowing ramp or nozzles.

The assembly of these blowing and suction pipes or nozzles constitutes the blowing and suction hood 5 which overhangs the track to be cleaned.

Figure 1:
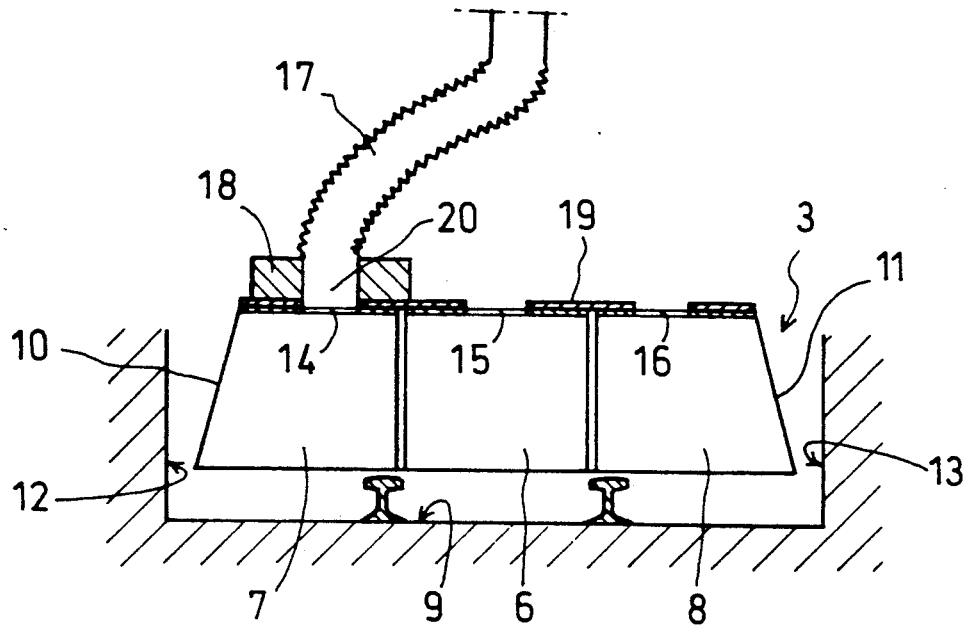
FIG. 1 is a schematic view in section of the three compartments of the first version.

In a first embodiment of a vacuum cleaning train of reduced dimensions intended for cleaning small and medium networks, the blowing and suction pipes are partitioned into three juxtaposed compartments, a central compartment 6 and two lateral compartments 7 and 8, as may be clearly seen in FIG. 1.

Each of these compartments 6, 7, 8 is fixed and overhangs a precise longitudinal zone of the track 9. The lateral compartments 7, 8 have slightly widening end edges 10, 11, so that the lower part of the corresponding compartment is in the immediate proximity of the walls 12, 13 surrounding the track 9.

Each of the compartments 6, 7 and 8 comprises in its upper part an opening 14, 15, 16.

A supple conduit 17, terminating in a blocking end piece 18, ensures connection of one of the compartments with either the blowing collector if it is question of a compartment of the blowing pipe, or with the suction fan if it is question of a compartment of the suction pipe.

On the upper face of compartments 6, 7, 8 is provided a slideway 19 in which may slide the blocking endpiece 18 of the supple conduit 17. The endpiece 18 is fast with two sets of jacks, a first set of jacks of horizontal axis ensuring displacement of the endpiece in the slideway 19 and a second set of jacks of vertical axis ensuring blocking of the endpiece on the slideway, when the free end 20 of the conduit 17 is placed opposite one of the openings 14, 15, 16.

The vacuum cleaner train according to this first version also comprises a system for automatically controlling the jacks of horizontal and vertical axes, enabling the driver of the train to select the compartments which will be operational, namely the central compartment 6, the lateral compartment 7, to the left in FIG. 1, the lateral compartment 8, to the right in FIG. 1.

Of course, the automatic control system effects in synchronization the positioning of the three supple conduits 17, corresponding to the three compartments aligned in the longitudinal direction, namely the central blowing compartment and the two suction compartments disposed upstream and downstream of this blowing compartment.

Being given that, in this first version, the work zone is limited to one third of the track 9, the suction and blowing powers are reduced proportionally and the dimensions of the suction and blowing fans are also of reduced size, whereby the vacuum cleaning train according to this first version is of small dimensions and of lower cost and is perfectly suitable for small and medium networks.

Figure 2:
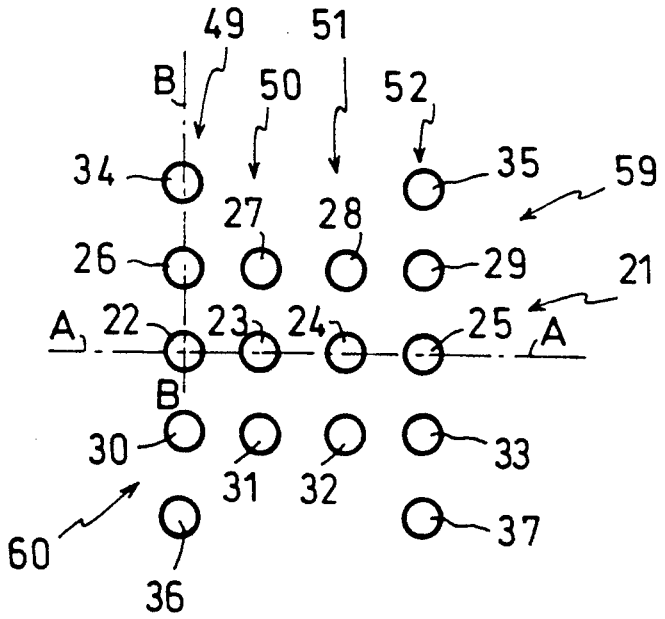
FIG. 2 is a symbolic representation of the arrangement of the suction and blowing nozzles of the train of the second version.

In a second embodiment, it is no longer question of blowing and suction pipes, but of individual nozzles. FIG. 2 schematically shows the arrangement of these nozzles, namely a set 21 of four blowing nozzles 22, 23, 24 and 25 respectively from left to right in FIG. 2, set 21 corresponding to an alignment of the four nozzles 22 to 25 transversely with respect to the direction of displacement of the train, and two sets 59 and 60 of six suction nozzles. In each set 59, 60, four of the six suction nozzles, 26 to 29 respectively for the first set, from left to right in FIG. 2, and 30 to 33 for the second set, from left to right in FIG. 2, are disposed opposite the four nozzles 22 to 25 of the blowing set 21. As for the other two suction nozzles, respectively 34 and 35 for the first set 59, and 36 and 37 for the second set 60, they are disposed in line with the lateral nozzles 22, 26 and 30 for nozzles 34 and 36, and 25, 29 and 33 for nozzles 35 and 37, respectively.

Laterally, there is therefore one blowing nozzle surrounded by two suction nozzles upstream and downstream.

Each of the four blowing nozzles 22 to 25 is connected to the blowing fan by a pipe 38 opening on the collector 39. The pipe 38 comprises a supple conduit 48 and a chamber 40 giving onto the collector 39.

This chamber 40 is equipped with an obturation system whose functioning is illustrated in FIG. 4. This system comprises a jack 41 mounted outside the chamber 40. The end 42 of the rod 43 of the jack 41 is fast with the plate 44 for obturating the chamber 40. This plate 44 pivots about pin 45 and is extended beyond this pin 45 by a rod 46 fast, by a ball joint, with the end 42 of the rod 43 of jack 41. On the inner periphery of the chamber 40 is placed an O-ring 47 forming stop for the obturation plate 44.

Figure 4A:
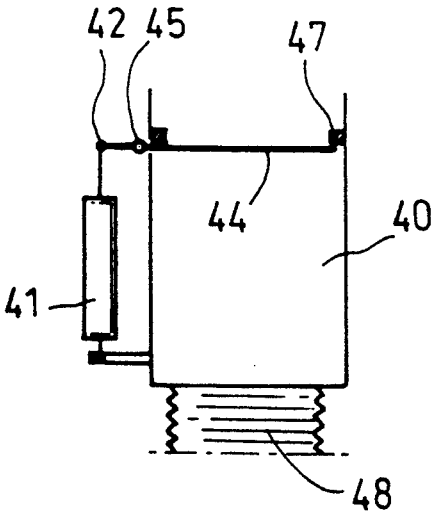
FIGS. 4*a* and 4*b* are partial views of the obturation flap valves of FIG. 3 in closed position (FIG. 4*a*) and open position (FIG. 4*b*).

FIG. 4*a* shows the obturation plate 44 in closed position, i.e. it is applied on the O-ring 47 and totally obturates chamber 40, preventing the passage of air coming from the fan and the collector 39 in the supple conduit 48.

Figure 4B:
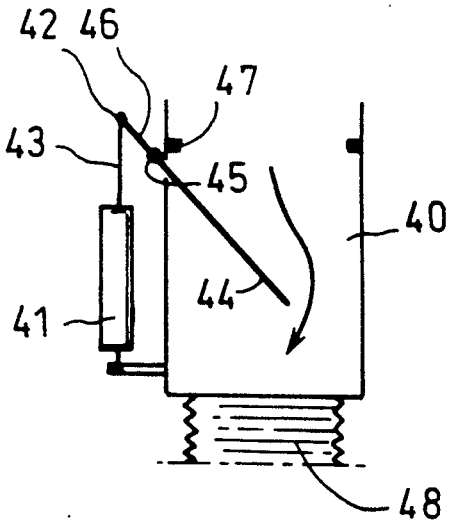

FIG. 4*b* shows the obturation plate in open position. Jack 41 has been actuated so that rod 43 emerges from the body of the jack, which displaces the free end of this rod 42. Such displacement pivots the ball joint fixed to this end 42 and rotates plate 44 about pin 45. Such rotation makes it possible to open pipe 38 and to obtain passage of air from the collector 39 towards the supple conduit 48.

Each jack 41 is connected to the automatic control system, which enables the driver of the train to cause all or part of the blowing and suction nozzles to function. It will be understood, on studying FIG. 2, that the automatism is adjusted so that this selection is effected along longitudinal rows 49, 50, 51 and 52.

Figure 3:
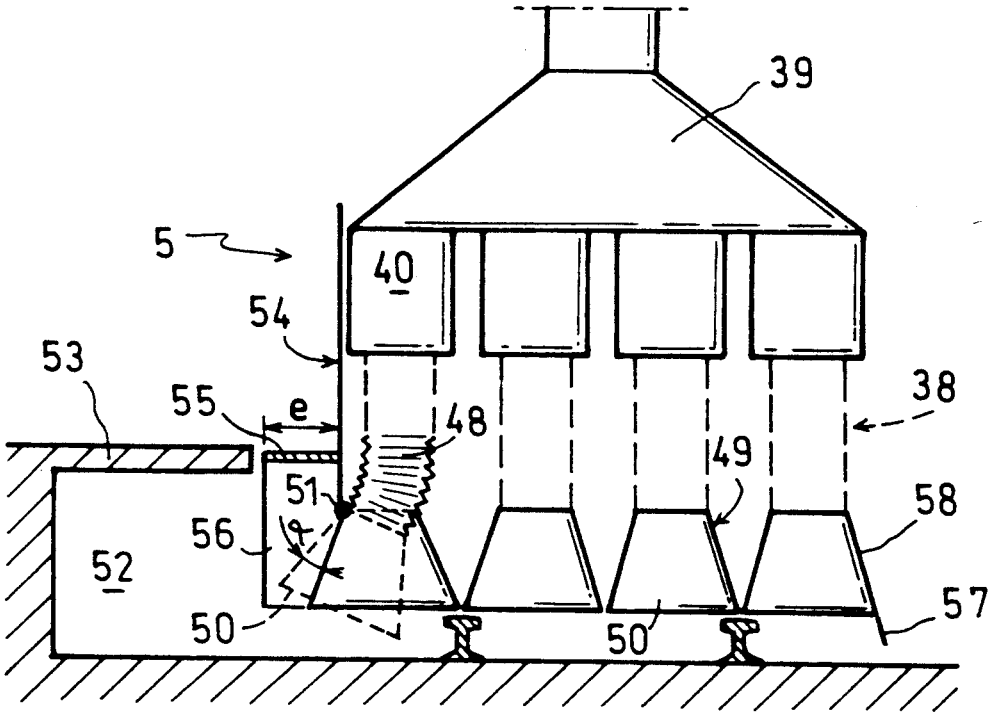
FIG. 3 is a schematic view in section along axis AA of FIG. 2.

Each pipe 38 is terminated by an endpiece 58 widening towards its lowermost part 50 so as to ensure good distribution of the blowing or suction air flow over the whole zone covered by the hood. This endpiece 58, which serves as deflector, is, at least for certain lateral nozzles, orientable by rotation about a horizontal and longitudinal pin 51. As may be seen in FIG. 3, the endpiece 58 may pivot by an angle $\alpha$ of the order of 20 to 30°, about pin 51, so that the lower part 50 is slightly raised towards the inner cavity 52 of the overhanging platform 53. The suction nozzles equipped with such an orientable endpiece are preferably the end nozzles 34 and 36 for row 49 and 35 and 37 for row 52. In this way, when cleaning a station presenting an overhanging platform 53, the operator controls, on the one hand, operation of only the nozzles of a lateral row, for example 49, and, on the other hand, pivoting of the endpieces 58 corresponding to the two end suction nozzles 34 and 36. All the dust and debris lifted by the high speed air jet coming from nozzle 22 is picked up either by the end suction nozzles 34 and 36 or by the intermediate nozzles 26 and 30. The deviation of the suction flows of nozzles 34 and 36 provoked by the pivoting of the corresponding endpieces 58, makes it possible to pick up the dust and debris at two levels in height and thus to obtain a greater efficiency of pick up. Such pivoting of the endpiece 58 about pin 51 is, of course, possible only thanks to the deformability of the supple conduit 48 and to the action of jacks (not shown), of which the end of the rod is fixed on endpiece 58.

Moreover, in order to complete this efficient cleaning, sealing strips have been fixed on the frame 54 of the train so as artificially to create a substantially tight caisson on the sides of the suction hood. The purpose of this artificial caisson is to avoid the dust and debris being projected by the air flow beyond the effective zone of action of the suction system. This artificial caisson is obtained by fixing a first sealing strip 55 horizontally in overhang with respect to the frame 54 of the train. This strip is rectangular, with a width of the order of 15 cm and a length which corresponds to the length of the suction hood. This strip 55 is positioned on the frame 54 at a height which corresponds substantially to the level of the overhanging platform 53. The artificial caisson is closed at its two ends by two vertical strips 56 fixed on the frame 54 of the train at the ends of the first strip 55 and therebelow. Each of the sealing strips is made of a rigid rubber of the conveyor belt type. The presence of these strips 55, 56 fixed outside the frame 54 of the train improves the efficiency of cleaning, particularly during passage past an overhanging platform.

In order to improve normal functioning of the vacuum cleaning train, it is possible to place sealing strips 57 on the endpieces 58 of the suction and blowing nozzles of the lateral rows 49 and 52 so as to allow better isolation of the air flows with respect to outside the suction hood.

What is claimed is:

1. A vacuum cleaner train with a blowing and suction hood which comprises:

a set of N, wherein N is equal to at least three, blowing nozzles disposed transversely to the direction of displacement of the train, including N−2 central blowing nozzles and two lateral blowing nozzles surrounding the central blowing nozzles;

two sets of N+2 suction nozzles, one set being located upstream and the other downstream of the set of blowing nozzles in the direction of displacement of the train, wherein each set of N+2 suction nozzles comprises N suction nozzles, which are exactly opposite the N blowing nozzles and include N−2 central suction nozzles and two lateral suction nozzles surrounding the central suction nozzles, and two end suction nozzles which are disposed beyond the N suction nozzles and respectively opposite the two lateral suction nozzles;

obturation means respectively provided in the nozzles;

means for controlling in synchronization the obturation means of the nozzles which are disposed in line and in parallel with the direction of displacement of the train so as to channel the blowing and suction flows;

deflectors for transversely deviating the respective suction and blowing flows, each lateral suction and blowing nozzle being terminated by such a deflector directed obliquely towards the outside of the hood;

supple conduits provided in the end lateral suction nozzles so that the correspond deflector is orientable by rotation about a horizontal and longitudinal axis of each conduit; and means for controlling the rotation of the orientable deflectors.

2. The vacuum cleaner train of claim 1, wherein N is equal to four.

3. A vacuum cleaner train with a blowing and suction hood which comprises:

a set of four blowing nozzles disposed transversely to the direction of displacement of the train, including two central blowing nozzles and two lateral blowing nozzles surrounding the central blowing nozzles;

two sets of six suction nozzles, one set being located upstream and the other downstream of the set of blowing nozzles in the direction of displacement of the train, wherein each set of six suction nozzles comprises four suction nozzles, which are exactly opposite four blowing nozzles and include two central suction nozzles and two lateral suction nozzles surrounding the two central suction nozzles, and two end suction nozzles which are disposed beyond the four suction nozzle and respectively opposite the two lateral suction nozzles;

obturation means respectively provided in the nozzles;

means for controlling in synchronization the obturation means of the nozzles which are disposed in line and in parallel with the direction of displacement of the train so as to channel the blowing and suction flows;

deflectors for transversely deviating the respective suction and blowing flows, each lateral suction and blowing nozzle being terminated by such a deflector directed obliquely towards the outside of the hood;

supple conduits provided in the end lateral suction nozzles so that the corresponding deflector is orientable by rotation about a horizontal and longitudinal axis of each conduit; and means for controlling the rotation of the orientable deflectors.

4. The vacuum cleaner train of claim 3, further comprising sealing strips which extend laterally from the blowing and suction hood and are disposed substantially tightly on the side of the train so as to form with a platform edge a caisson.

5. The vacuum cleaner train of claim 4, wherein the sealing strips consists of a horizontal strip extending over the whole length of the hood and terminated at its end by two vertical strips, said strips being fixed in overhang on a frame of the hood.

* * * * *